United States Patent [19]

Boehmer

[11] Patent Number: 4,521,123

[45] Date of Patent: Jun. 4, 1985

[54] METHOD AND APPARATUS FOR THE REPRESENTATION OF CHARACTERS

[75] Inventor: Georg Boehmer, Munich, Fed. Rep. of Germany

[73] Assignee: Siemens Aktiengesellschaft, Berlin & Munich, Fed. Rep. of Germany

[21] Appl. No.: 530,622

[22] Filed: Sep. 9, 1983

[30] Foreign Application Priority Data

Sep. 27, 1982 [DE] Fed. Rep. of Germany ..... 3235676

[51] Int. Cl.[3] ..... B41J 3/12

[52] U.S. Cl. ..... 400/124; 101/93.05; 400/121

[58] Field of Search ..... 400/124, 121; 101/93.05, 93.04; 178/15, 30

[56] References Cited

U.S. PATENT DOCUMENTS 4,037,705 7/1977 Martin et al. ..... 400/124

4,159,882 7/1979 Sanders et al. ..... 400/124

*Primary Examiner*—Paul T. Sewell

*Attorney, Agent, or Firm*—Hill, Van Santen, Steadman & Simpson

[57] ABSTRACT

Upon employment of a print element moved in line direction, those strokes containing an ascender are printed in a first motion of the print element for the representation of characters whose strokes respectively comprise a central area, a central area and an ascender or a central area and a descender. Subsequently, the recording medium is displaced relative to the print element such that those strokes containing descenders can be printed during a second motion of the print element. Those strokes which contain only a central area are printed either during the first motion or during the second motion of the print element. The recording medium is subsequently displaced by a height allocated to a line spacing.

11 Claims, 2 Drawing Figures

METHOD AND APPARATUS FOR THE REPRESENTATION OF CHARACTERS

BACKGROUND OF THE INVENTION

1. Field of the Invention

The invention relates to a method and apparatus for the representation of characters.

2. Description of the Prior Art

It is generally known to represent characters, i.e , their strokes, in office typewriters, teleprinters or data printers by the use of a print element designed as a matrix print element. Given employment of a print element which is moved in the line direction relative to a recording medium during the printing operation, it is standard to arrange a plurality of print elements adjacent to and above one another. During the motion of the printing element, different print elements are driven controlled by data words stored in a character generator and the characters are printed on the recording medium in a prescribed dot matrix. Wire matrix printing elements can be employed as printing elements, printing needles being selectively actuated therein by means of magnetic elements. Ink printing elements can also be provided as printing elements, ink droplets being electively ejected from nozzles given these.

Those characters whose strokes, such as the lower case letters "a", "c" only exhibit a central area and no ascenders and descenders are printed by a first portion of adjacent printing elements. Those characters whose strokes exhibit a central area and at least one ascender such as, for example, upper case letters and some of the lower case letters such as "d" and "f", are printed by the first and second part of the printing elements. Finally, those characters whose strokes exhibit a central area and a descender, for example, the lower case letter "g", "p", are printed by the first and third part of the printing elements. It is also possible to represent capitalized printing with the assistance of all printing elements, this consisting of upper case letters which are printed by all printing elements.

In case even larger characters are desired, it is conceivable to print an upper part of the characters during a first motion of the print element in a line direction, to then shift the recording medium perpendicularly relative to the line direction by the height of said first part and to subsequently print the second part of the characters during a second motion of the print element in the line direction. The directions of the first and second line direction motions of the print element can coincide or can proceed in opposite directions for instance, left or right. In the former instance, a return of the print element into its initial position is carried out after printing the first part of the characters and the second motion is subsequently carried out; whereas, in the second instance, the print of the second part of the characters ensues during the return of the print element.

Such a method has the disadvantage that an offset can occur within the characters as a result of impressions in the forward feed of the recording medium and the legibility of the individual characters is thereby deteriorated.

SUMMARY OF THE INVENTION

It is therefore an object of the invention to specify a method and an apparatus upon whose employment an offset-free impression of the strokes of characters is also achieved when the line height is greater than the height allocated to a print element and when two successive motions of the print element with an intervening forward feed of the recording medium are required for printing the characters.

Given a method of the type initially cited, this object is inventively achieved by means of, printing all of the characters having an ascender during one line motion of the print element, and all the characters having a descender are printed during a second line motion of the print element after the recording medium has been shifted appropriately. Characters with only a central area could be printed in either the first or second line motion. A line feed then advances the recording medium prior to printing the next line.

The method according to the present invention has the advantage that a large line height can be achieved with a relatively small print element. Given, for example, the use of a matrix-type print element, deriving therefrom is a lower number of individual printing elements required so that the print element can be inexpensively manufactured. Less energy is required for the motion of the print element as a result of its lower mass. Imprecisions in the displacement of the recording medium relative to the print element do not appear as an offset within the strokes of the individual characters but appear, if at all, from character to character. The legibility of the individual characters is not thereby deteriorated.

Further, the method according to the invention has the advantage that a carriage feed mechanism required for the motion of the recording medium can be inexpensively constructed since, for example, no adjustment of tooth play and no lock-in positions are required. In comparison to printing with a correspondingly larger print element, at least two respective motions of the print element are required for printing the characters by this inventive method as opposed to only one with the previously known methods, but a high printing speed is also attainable with the method according to the invention since higher tolerances are admissible when printing.

It proves expedient given this inventive method to print those characters which contain only a central area during the first motion of the print element. The printing can ensue unidirectionally or bidirectionally. Given unidirectional printing, the print element is returned into an initial position after the first motion and the second motion is executed after the partial advance of the recording medium. Given bidirectional printing, the second motion is executed immediately after the first motion and the partial advance of the recording medium. It is fundamentally possible to also carry out the partial advance when a character with a descender follows a character with a central area or a central area and an ascender. It proves expedient, however, to first print all characters of a line which exhibit the central area and the central area and ascenders and to then execute the partial advance in order to print all characters of a line having a central area and a descender.

It proves expedient particularly for the representation of Arabic characters, to dimension the partial advance such that a ratio of approximately 3:1 derives for the line height to the central area. Given the use of a matrix print element, this partial advance corresponds, for example, to the height allocated to half the number of printing elements. The mosiac print element is preferably designed as a wire matrix print element or as an ink element.

An advantageous arrangement or apparatus for executing the method contains a control unit which emits a control signal initiating the first motion to a carriage control and subsequently supplies the print element with the characters to be printed during the first motion. Subsequently the control unit emits a first advance signal initiating the partial advance to the carriage feed control, then it emits a signal to the carriage control which initiates the second motion of the print element. Thereafter, the control unit supplies the print element with the characters to be printed during the second motion.

BRIEF DESCRIPTION OF THE DRAWINGS

The method according to the invention and an arrangement for the execution of the method are explained below in greater detail with reference to drawings. Shown are.

Figure 1:
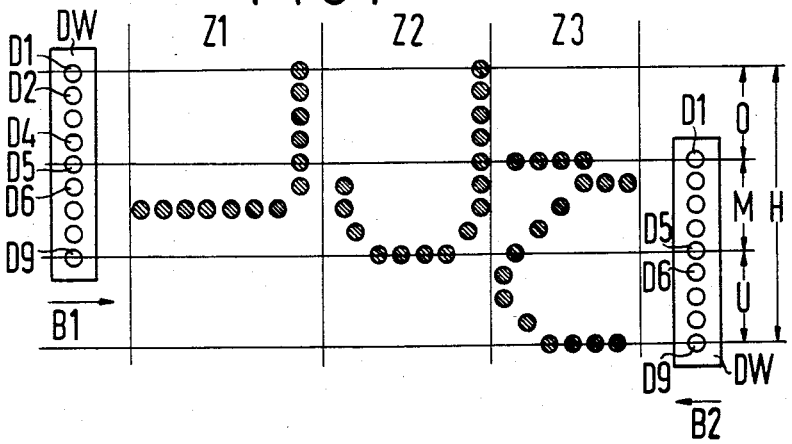
FIG. 1 an illustration of characters represented upon employment of the method.

The characters Z1, Z2 and Z3 illustrated in FIG. 1 are, for example, Arabic characters, whose strokes are represented in a half-step raster by a print element DW. The print element DW contains nine individual elements D1 through D9 which are disposed adjacent to and above one another in vertical alignment. The height allocated to the sum of the printing elements D1 through D9 is smaller than the line height H. The characters Z1 and Z2 exhibit a central area in a zone identified at M and respectively one ascender in a zone identified at O, whereas the character Z3 exhibits a central area in the zone identified at M and a descender in a zone identified at U. Characters whose interconnected strokes exhibit both descenders as well as ascenders do not exist given Arabic characters, similar to the case given Latin characters.

During a first motion in a direction indicated by arrow B1 of the print element DW in the line direction, the characters Z1 and Z2 as well as further characters (not illustrated) of the line are printed proceeding from a starting position. These characters exhibit only a central area in zone M or a central area in zone M and/or at least one ascender in zone O. What is here meant by the word "characters" are the strokes of the characters which can be designed line-like or punctiform as well. The ascenders in zone O are printed by the individual printing elements D1 through D4 and the central areas in zone M are printed by the individual printing elements D5 through D9. A partial advance of the recording medium relative AT to the print element DW and perpendicular to the line direction ensues at the end of the line such that those characters which exhibit a central area in zone M and a descender in zone U can be printed during a second motion in a direction shown by arrow B2. The central areas in zone M are printed by the printing elements D1 through D5 and the descenders in zone U are printed by the printing elements D6 through D9.

In an unidirectional printing mode, that is, when all of the characters are printed by the print element DW moving in only one direction such as that shown by arrow B1, a return of the print element DW its starting position is required after the partial advance of the recording medium AT and the second motion B2 ensues in the same direction as bidirectionally. In this case, the direction of the motion B2 is opposite the direction of the motion B1 and the return of the print element DW into its initial position is not required. A line feed of the recording medium AT is required in order to produce a line spacing to the following line after printing all characters during the motion B2. Subsequently, a motion B1 of the print element DW is again executed in order to print the next line of characters.

The height of the partial advance of the recording medium AT normally corresponds to the height of the ascenders, that is, the height of zone O. When utilizing a matrix print element, for example, it is approximately equal to the height of half the number of individual printing elements in the print element DW. A ratio of line height H to the height of the central area M of 3:1 thereby derives. This ratio proves particularly useful for the representation of Arabic characters.

Further details of the method are described below in conjunction with the arrangement for the execution of the method illustrated in FIG. 2.

Figure 2:
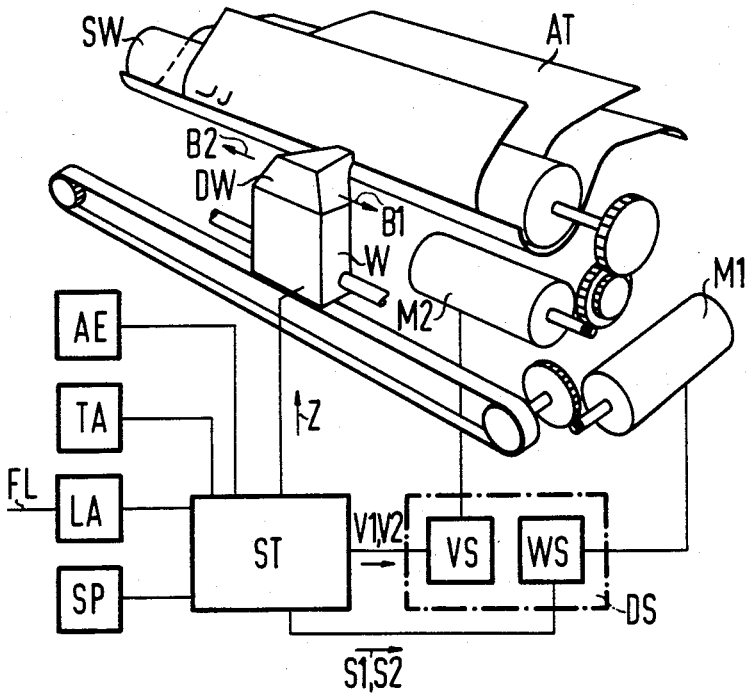
FIG. 2 an arrangement for the execution of the method.

In the arrangement or apparatus illustrated in FIG. 2, the print element DW is disposed and secured on a print carriage W which is moved along a platen SW upon employment of a motor M1, preferably a stepping motor. The platen SW is driven over a transmission T by a motor M2, preferably likewise a stepping motor. A recording medium AT on which the characters are printed is placed around the platen SW.

As seen in the schematic diagram of FIG. 2, input of the characters ensues over a keyboard TA, over a long-distance line FL connected to a line adapter LA, or over a memory SP. In any instance, the input characters are supplied to a control unit ST which controls the chronological sequences of all events and preferably contains a microcomputer. The control unit ST is connected to a printer control DS which contains a carriage control WS connected to the motor M1 and a platen feed control BS connected to the motor M2.

At the beginning of character printing, the printer carriage W together with the print element DW is situated in an initial position at the edge of the recording medium AT. The characters of a line input over the keyboard TA, the memory SP or the line adapter LA are first represented at a display unit AE. When all characters of a line have been input and the character "carriage return" has likewise been input, the control unit ST transmits a signal S1 to the carriage control WS which initiates a first motion B1 of the print element DW in a horizontal direction. Simultaneously, the control unit ST transmits all characters, such as Z1 and Z2 shown in FIG. 1, which contain a central area in zone M and at least one ascender in zone O to the print element DW which represents these characters on the recording medium AT. When the end of the line has been reached, the control unit ST transmits a first feed signal V1 to the platen feed control VS which, upon employment of the motor M1, effects a partial advance of the recording medium AT perpendicular to the line direction. The height of the partial advance is dimensioned such that all characters, such as Z3, having a central area in zone M and a descender in zone U can now be represented. After the partial advance, the control unit ST transmits a signal S2 to the carriage control WS which initiates the second motion B2 of the print element DW during which the print element DW is returned into its initial posiiton and, simultaneously, prints the corresponding characters with descenders in zone U. After printing all characters of a line, the control ST generates a further feed signal V2 which initiates a line feed of the recording medium AT.

Unidirectional printing can also be carried out instead of the bidirectional printing. In this case, the print element DW is returned into its initial position at one end of the line after printing the characters having a central area in zone M and at least one ascender in zone O and, subsequently, the characters having a central area in zone M and a descender in zone U are printed in the same direction of motion. Another return into the initial position subsequently ensues. The partial advance and the line feed can thereby ensue either at the end of the line, at the beginning of the line or during the return of the print element DW to the initial position.

Those characters which exhibit only a central area M are preferably printed during the first motion B1 of the print element DW. However, it is also fundamentally possible to print these during the second motion B2.

The method and the arrangement are suitable not only for the representation of characters of the Arabic or similar scripts, but are also suitable for the representation of Latin characters. In this case, all upper case letters, numerals, lower case letters having a central area in zone M and lower case letters having an ascender in zone O as well as a majority of the punctuation marks are printed during the first motion B1 of the print element DW and all lower case letters having a central area in zone M and a descender in zone U as well as the remaining punctuation marks are printed during the second motion B2 of the print element DW. The only exception is formed by the character "j" given which the dot, being in zone O, is printed during the first motion B1 and the actual character, being in zones M and U, during the second motion B2. By use of this method and apparatus, it is ensured that no offset appears within the characters. An offset between the individual characters is minimal and will only occur as a result of component tolerances.

It is also possible to respectively execute the partial advance before the corresponding character; it proves particularly expedient, however, to nonetheless delay execution of the partial advance until the end or the beginning of a line.

As is apparent from the foregoing specification, the invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limited of the present invention, excepting as it is set forth and defined in the hereto appended claims.

I claim as my invention:

1. A method for the representation of characters having a central area and characters having a central area with ascenders and or descenders upon employment of a print element which is moved in horizontal direction relative to a recording medium during the print operation, characterized by the following method steps:

(a) printing the entire characters of all those character in a line which exhibit a central area and/or at least one ascender during a first horizontal motion of the print element along the line;

(b) displacing the recording medium relative to the print element perpendicular to the line direction by a partial advance such that the characters having a central area and a descender are subsequently printable;

(c) printing the entire character of all those characters in a line having a central area and a descender during a second horizontal motion of the print element along the line;

(d) printing those characters which exhibit only a central area either during the first motion or the second motion of the print element;

(e) displacing the recording medium relative to the print element in accord with a line feed after printing all characters of a line.

2. The method according to claim 1, wherein printing the characters which contain only a central area is done during the first motion of the print element.

3. The method according to claim 1, wherein the the directions of the first and of the second motion of the print element during printing coincide.

4. The method according to claim 1, wherein the directions of the first motion and of the second motion of the print element when printing the characters are opposite one another.

5. The method according to claim 1, wherein the displacing of the recording medium by the partial advance is dimensioned such that a ratio of overall height of a line relative to the central area of 3:1 derives.

6. The method according to claim 1, wherein a matrix print element having a plurality of printing elements is employed as the print element.

7. The method according to claim 6, characterized in that a wire matrix print element is employed as the print element.

8. In an apparatus for representing characters having strokes within a middle zone for a central area and an upper zone for ascenders or a lower zone for descenders comprising:

carriage means mounted for horizontal movement, motor means for moving said carriage horizontally, print element means carried on said carriage means for movement therewith;

platen means rotatable about a horizontal axis for carrying a recording medium, motor means for rotating said platen, feed control means for controlling operation of said platen motor, input means for receiving characters to be represented, and control unit means for receiving said input means, for controlling said carriage control means and said feed control means and for transmitting said characters to said print element means for representation on said recording medium, said print element means comprising a plurality of individual printing elements adjacent to and above one another, the number and spacing of said individual elements having a height corresponding to two of said zones, the improvement comprising:

means for printing the entire character of all those characters in a line which exhibit a central area and/or at least one ascender during a first horizontal motion of the print element along the line;

means for displacing the recording medium relative to the print element perpendicular to the line direction by a partial advance such that the characters having a central area and a descender are subsequently printable;

means for printing the entire character of all those characters in a line having a central area and a descender during a second horizontal motion of the print element along the line;

means for printing those characters which exhibit only a central area either during the first motion or the second motion of the print element;

means for displacing the recording medium relative to the print element in accord with a line feed after printing all the characters of a line;

whereby, characters having a central area and an ascender are printed during a first horizontal movement of said carriage means and characters having a central area and a descender are printed during a second horizontal movement of said carriage means after said platen means has been rotated by a partial advance in an amount equal to the height of one zone, characters having only a central area being printed during either said first movement or said second movement.

9. The apparatus of claim 8, wherein said control unit means includes a microcomputer.

10. The apparatus of claim 8, wherein said print element comprises a wire matrix print element.

11. In an apparatus for representing characters having a central area within a middle zone for and in an upper zone or in a lower zone descenders or ascenders comprising:

means for printing the entire character of all those characters in a line which have a central area and/or at least one ascender during a first horizontal motion of the print element along the line;

means for displacing the recording medium relative to the print element perpendicular to the line direction by a partial advance such that the characters having a central area and a descender are subsequently printable;

means for printing the entire character of all those characters in a line having a central area and a descender during a second horizontal motion of the print element along the line;

means for printing those characters which have only a central area either during the first motion or the second motion of the print element; and means for displacing the recording medium relative to the print element in accord with a line feed after printing all the characters of a line;

whereby, characters having a central area and an ascender are printed during a first horizontal movement of said carriage means and characters having a central area and a descender are printed during a second horizontal movement of said carriage means after said platen means has been rotated by a partial advance in an amount equal to the height of one zone, characters having only a central area being printed during either said first movement or said second movement.

* * * * *